US005699927A

United States Patent [19]

Lane et al.

[11] Patent Number: 5,699,927

[45] Date of Patent: Dec. 23, 1997

[54] BEVERAGE CUP LID HAVING PERPHERAL LOCKING MEANS FOR DRINKING OPENING CLOSURE MEMBER

[75] Inventors: William F. Lane, Wilson; Robert C. Williams, Raleigh, both of N.C.

[73] Assignee: Bailey Marketing Group, Inc., Rocky Mount, N.C.

[21] Appl. No.: 598,562

[22] Filed: Feb. 12, 1996

Related U.S. Application Data

[63] Continuation of Ser. No. 307,303, Sep. 16, 1994, Pat. No. 5,490,609.

[51] Int. Cl.[6] ..... B65D 51/15; A47G 19/22

[52] U.S. Cl. ..... 220/254; 220/711; 220/712; 220/713

[58] Field of Search ..... 220/711, 712, 220/713, 254, 268

[56] References Cited

U.S. PATENT DOCUMENTS

| | | | |
|---|---|---|---|
| 3,860,162 | 1/1975 | Schutz | 220/711 |
| 4,113,135 | 9/1978 | Yamazaki | 220/268 |
| 4,138,033 | 2/1979 | Payne et al. | 220/254 |
| 4,184,604 | 1/1980 | Amberg et al. | 220/254 |
| 4,190,174 | 2/1980 | Haimowitz | 220/254 |
| 4,345,695 | 8/1982 | Galloway et al. | 220/254 |
| 4,361,249 | 11/1982 | Tuneski et al. | 220/254 |
| 4,377,244 | 3/1983 | Rossetti | 220/268 |
| 4,412,629 | 11/1983 | Dart et al. | 220/254 X |
| 4,537,326 | 8/1985 | Morehead | 220/269 |
| 4,615,459 | 10/1986 | Clements | 220/254 |
| 4,629,088 | 12/1986 | Durgin | 220/254 |
| 4,949,865 | 8/1990 | Turner | 220/254 X |

*Primary Examiner*—Allan N. Shoap
*Assistant Examiner*—Robin A. Hylton
*Attorney, Agent, or Firm*—Richard S. Faust

[57] ABSTRACT

A thin, plastic lid for disposable drinking cups has a drinking opening formed in a raised portion of the lid. The drinking opening is covered by a hinged closure member that is locked in place by trapping an outer marginal edge of the closure member between the cup rim and the periphery of the lid. The lid may be formed by conventional vacuum forming and die cutting operations.

23 Claims, 4 Drawing Sheets

BEVERAGE CUP LID HAVING PERPHERAL LOCKING MEANS FOR DRINKING OPENING CLOSURE MEMBER

This is a continuation of application Ser. No. 08/307,303 filed Sep. 16, 1994, now U.S. Pat. No. 5,490,609.

FIELD OF INVENTION

The invention relates to lids for beverage cups such as disposable drinking cups of the type commonly used by fast food restaurants and convenience stores for the sale of coffee. More particularly, the invention relates to thin plastic beverage cup lids having a drinking opening that is accessed by moving a hinged closure member and is reclosable by returning the closure member to overlie the drinking opening.

BACKGROUND OF THE INVENTION

Hot beverages such as coffee and hot chocolate are typically sold by fast food restaurants and convenience stores in disposable drinking cups. In order to prevent spillage of the beverage, the cups are often provided with lids that have drinking openings permitting drinking therethrough without removing the lid.

Satisfactory lids formed of relatively heavy plastic material, for example the lid of U.S. Pat. No. 4,949,865, have excellent structural integrity and provide good results in terms of convenience and comfort for the customer. One drawback of these lids is that they generally include a vertical lip at the periphery over which the drink must flow in order to go from the drinking opening to the customer's mouth. Another drawback of these lids is cost.

Other lids formed of thin plastic material, for example the lid disclosed in U.S. Pat. No. 4,738,373, overcome the above-mentioned cost problem, but these lids provide markedly inferior results in terms of operation of the closure member and the aesthetics of drinking from an opening with sharp corners.

Thus, there is a need for a drinking cup lid that has the operational and aesthetic advantages associated with more expensive, thick plastic lids, but at a cost competitive with the thin plastic lids of the prior art.

SUMMARY OF THE INVENTION

The present invention provides a novel drinking cup lid that may be formed of thin plastic material by conventional vacuum forming and die cutting operations, while providing the excellent aesthetic and operational features heretofore associated only with lids costing several times as much. More particularly, the lid of the present invention provides a smooth, single level drinking opening for the mouth to comfortably fit over. Furthermore, the lid of the invention eliminates jagged edges at the drinking opening that can cause discomfort.

The present invention may be defined as a drinking cup lid that includes a cover portion for covering the open mouth of the drinking cup and an annular cavity at the periphery of the cover portion for frictionally engaging the rim of the cup. A drinking opening is formed in a raised portion and extends outwardly to the lid periphery. A closure member for the drinking opening is hinged to the cover portion and has a radial dimension greater than that of the drinking opening to permit an outward marginal edge portion of the closure member to be trapped between the rim of the drinking cup and an overlying part of the lid.

BRIEF DESCRIPTION OF THE DRAWINGS

Some of the objects having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which aspects of the preferred manner of practicing the present invention are shown, it is to be understood at the outset of the description which follows that persons of skill-in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
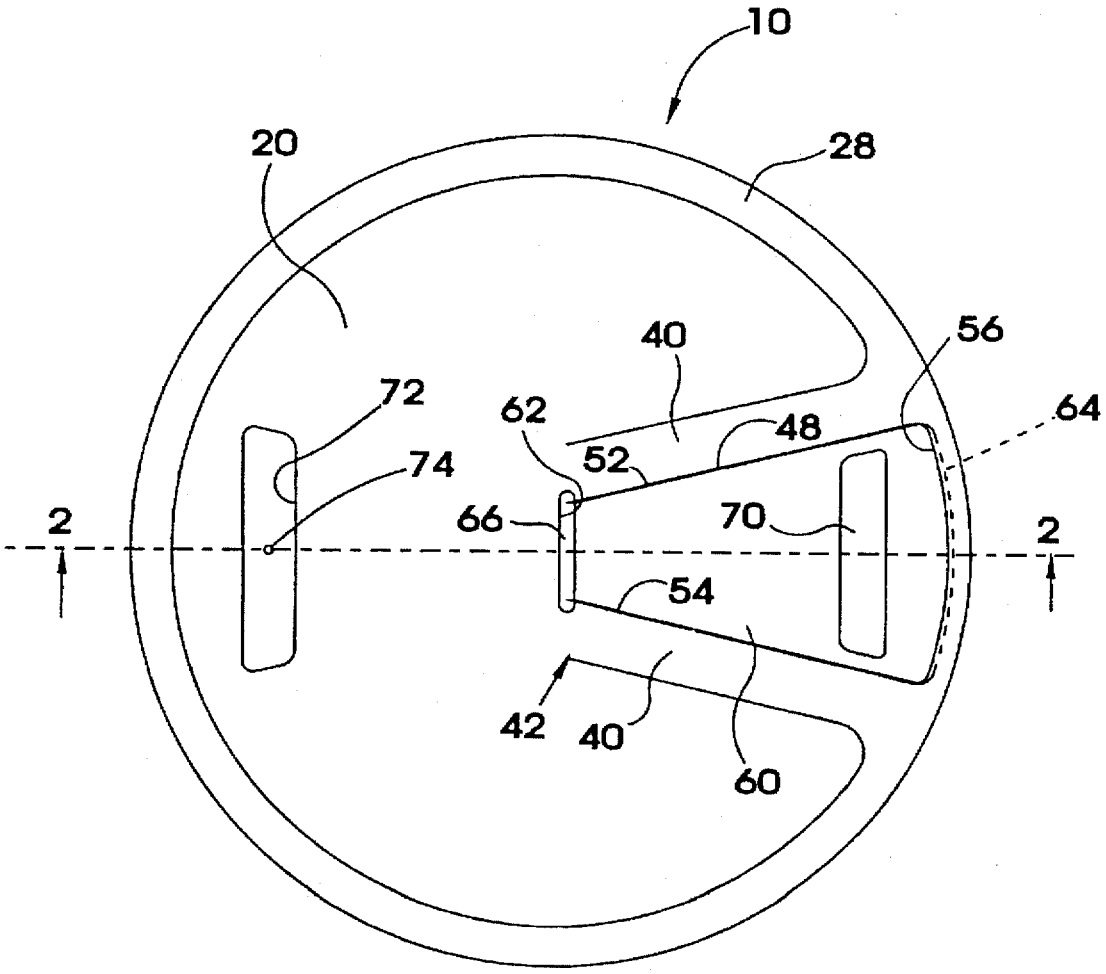
FIG. 1 is a top view of a beverage cup lid constructed in accordance with the principles of the present invention.
Figure 2:
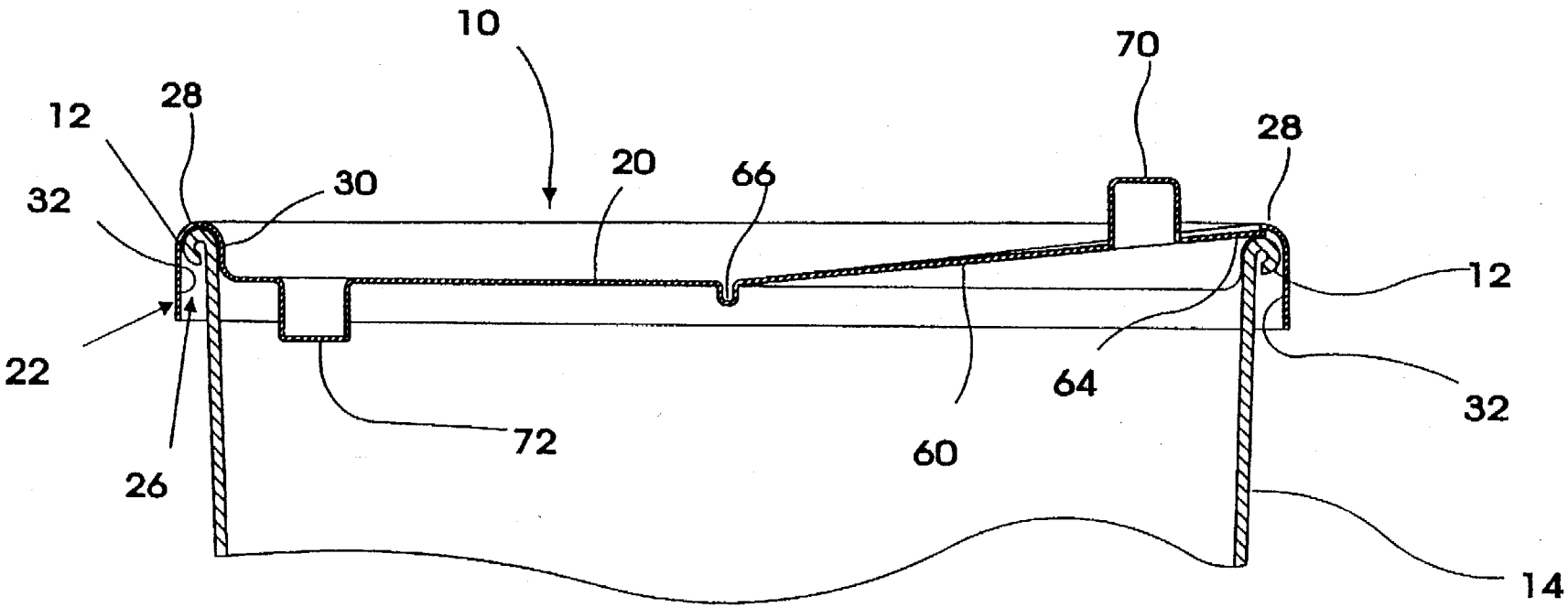
FIG. 2 is a cross-section view taken along line 2—2 of FIG. 1.

Referring to the drawings, and particularly to FIGS. 1 and 2, there is shown a drinking cup lid 10 constructed in accordance with the principles of the present invention in place on the rim portion 12 of an open-mouthed drinking cup 14. Lid 10 includes a generally planar, horizontally disposed cover portion 20 for covering the open mouth of drinking cup 14. An annular cavity 22 is formed at the periphery of cover portion 20 for frictionally engaging the rim portion 12 of the drinking cup to hold the lid firmly in place to prevent spillage of the beverage, e.g., coffee, contained therein. In the illustrated embodiment, cavity 22 is defined by an inverted U-shaped well 26 that has an upper closed end 28 and a pair of spaced-apart inner and outer walls 30 and 32, respectively, which are joined to the closed end. Walls 30, 32 serve to frictionally engage the rim portion of the drinking cup with sufficient gripping force to prevent beverage spillage. In the illustrated embodiments, the outer wall 32 and closed end 28 of well 26 extend continuously around the entire periphery of lid 10; however, the gripping action of the well structure is interrupted along a discrete arcuate portion of the periphery, approximately 45° in the illustrated embodiment, where the inner wall 30 is interrupted to make room for the drinking opening and its unique cooperation with the closure member, as described in detail below. It will be appreciated that this angle may vary within acceptable limits, for example, 25° to 60°, with smaller angles usually being preferred for larger lids and larger angles for smaller lids.

Cover portion 20 includes a raised portion 40 that extends radially outwardly and upwardly from a central location 42 on the cover portion to the periphery of the lid. At the periphery, raised portion 40 joins the upper closed end 28 of well 26 at the above-mentioned 450 arcuate portion of the periphery where the inner wall 30 is interrupted. Thus, the raised portion terminates at the upper level of the lid such that there is no vertical lip where the raised portion reaches the lid periphery.

A drinking opening 48 is formed in raised portion 40 by steel rule die cutting or like operation that forms cuts through the plastic lid material along substantially radial, straight lines 52, 54 in raised portion 40. A third curved cut joining the outermost ends of cuts 52, 54 is formed along line 56 in upper closed end 28 of well 26. The material bounded by and within cuts 52, 54, 56 defines a closure member 60 for the drinking opening. Closure member 60 is joined to cover portion 20 by an integral, living hinge 62 that serves as the fourth side of the closure member.

An important feature of the invention is that the closure member 60 has a radial dimension greater than that of drinking opening 48 that permits an arcuate, marginal edge portion 64 (shown in dashed lines in FIG. 1) of the closure member to reside under the upper closed end 28 of well 26 in such a manner that the marginal edge portion 64 is trapped between the rim portion 12 of the drinking cup and the upper closed end 28 of well 26 to lock the closure member in a closed position.

In a preferred manner of practicing the invention, the extended radial length of closure member 60 is achieved by utilization of an indentation 66 located at or near the living hinge 62. Simultaneous with, or following, the die cutting of the drinking opening along lines 52, 54, 56, indentation 66 is flattened to translate the closure member radially outwardly. While the plastic material forming lid 10 has a memory, the recovery from flattening indentation 66 is well under 100%, resulting in the extended length for the closure member. Other means for providing the closure member with a radial dimension that extends beyond the third cut 56 may be employed. For example, after forming cuts 52, 54, 56, the closure member may be pulled to stretch the plastic material in the radial direction.

Figure 3:
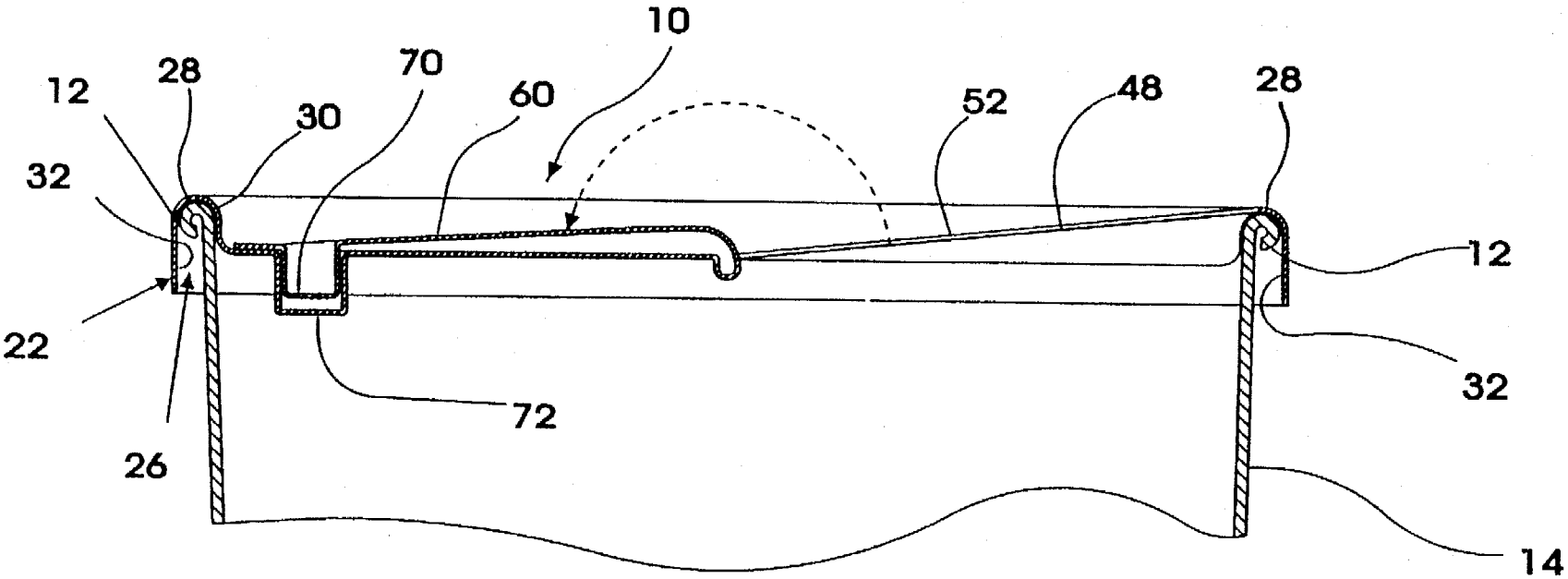
FIG. 3 is a view similar to FIG. 2 showing the closure member hinged to the open, drinking position.

As shown in FIGS. 1–3, closure member 60 may be provided with a hand engagable projection, for example knob 70, to facilitate lifting of the closure member to gain drinking access to the contents of the cup via drinking opening 48. A mating recess 72 may be formed in cover portion 20 to permit the closure member to be locked into place when it is hinged fully open by press fitting knob 70 into recess 72 (FIG. 3). A small vent opening 74 may be provided, for example within recess 72, to permit steam to escape from the interior of cup 14.

In use, it will be appreciated that multiple lids 10 may be stacked or nested as in the customary manner. When a single lid 10 is removed from a stack of lids for placement on a cup, closure member 60 preferably will reside below the plane of raised portion 40. Thus, when lid 10 is placed on a cup, the outward marginal edge portion 64 of closure member 60 is positioned to become trapped between cup rim 12 and an overlying part of the lid, in the instance, the opposing well wall 28. This trapping action serves to lock the closure member in place substantially coplanar with the upper surface of raised portion 40 to provide a secure cover for drinking opening 48. It will be appreciated that the trapping action of marginal edge portion 64 between cup rim 12 and wall 28 may be achieved with or without edge portion 64 being physically engaged or "pinched" between rim 12 and wall 28. Stated differently, edge portion 64 may be positively pinched or may reside somewhat loosely between rim 12 and wall 28.

When the customer wishes to drink from the cup, the customer simply hand engages knob 70 and pivots the closure member about hinge 62, with or without locking the closure member to the cover via knob 70 and recess 72 (FIG. 3), as desired. The drinking opening may be reclosed by moving the closure member back to the closed position shown in FIG. 1, with a slight downward pressure exerted on knob 70 serving to deform the closure member to permit the marginal edge 64 to slide under wall 28 and become trapped again between wall 28 and cup rim 12.

Thus, the above-described structure provides an integral, thin plastic lid that may be easily formed by the conventional operation used to form thin plastic lids of the prior art, namely thermoforming by vacuum plus a die cutting operation for forming the drinking opening, with much improved operational features. In this regard, it will be appreciated that the lid of the present invention provides at least the following advantages over thin plastic lids of the prior art:

1) The closure member may be easily pivoted to expose the drinking opening and thereafter locked into place to prevent the annoyance and safety considerations associated with a dangling closure member or "lift tab."
2) As distinct from the prior art lids that can include jagged edges that permit drops of coffee to form at the outer edge of the drinking opening and drip from the cup or down the side of the cup, the present invention provides a clean drinking opening without jagged edges and without the necessity of the beverage flowing over a lip located between the drinking opening and the drinker's mouth.
3) As distinct from prior art lids, the present invention provides a smooth, single level drinking opening for the mouth to comfortably fit over, resulting in a significant aesthetic improvement in that the beverage flows directly out of the drinking opening into the drinker's mouth.

Figure 4:
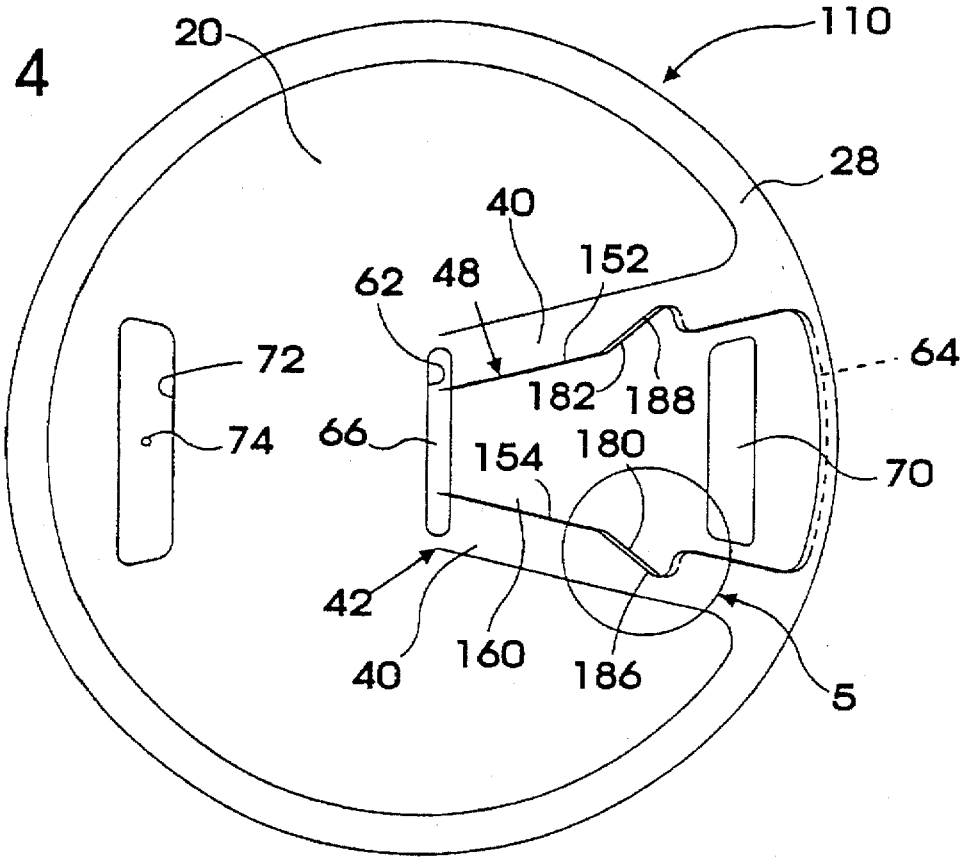
FIG. 4 is a top view of an alternative embodiment beverage cup lid identical to the lid of FIGS. 1–3 with the exception of the addition of ears on the closure member to facilitate locking of the closure member in the closed position.
Figure 5:
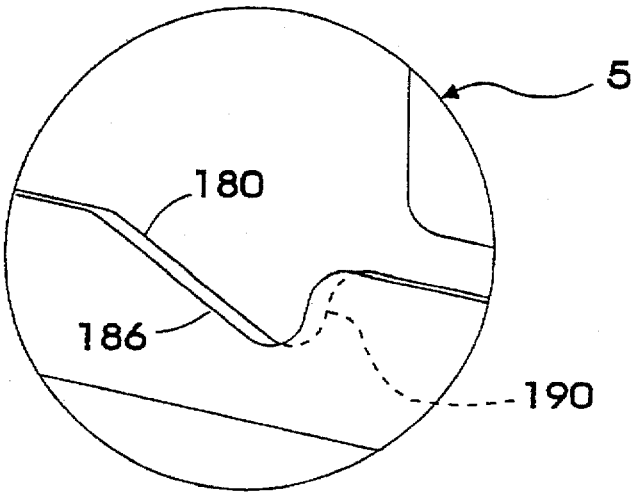
FIG. 5 is a greatly enlarged view of the portion of the lid contained within the circle 5 of FIG. 4, showing one of the ears on the closure member and adjacent portions of the lid.

An alternative embodiment lid 110 is shown in FIGS. 4 and 5, with parts identical to those of lid 10 being referred to by the same reference numerals used in FIGS. 1–3. The structure of lid 110 and its manufacture are identical to that of lid 10 with the exception that the die cutting operation forms closure member 160 with a pair of ears 180, 182, and forms the drinking opening sides 152, 154 with matching recesses 186, 188. This ear structure serves to enhance the locking of the closure member in the closed position by providing two additional areas where the closure member underlies adjacent portions of the cover. With reference to the enlarged view of ear 180 and recess 186 in FIG. 5, it will be appreciated that, after closure member 160 is extended radially outwardly by flattening indentation 66, a marginal edge portion 190 (shown in dashed lines in FIG. 5) underlies the cover adjacent to recess 186. Thus, both the locking of closure member 160 to the cover and protection against spillage are enhanced by the ear-recess structure of the embodiment illustrated in FIGS. 4 and 5.

In a preferred manner of practicing the invention, lid 10 is vacuum formed from a high-impact styrene polymer (e.g., ABS) material and has an average thickness on the order of 0.015 inches. The flattening of indentation 66 is achieved simultaneously with the die cutting operation by the use of a single projection on the die. The flattening of indentation 66 produces a radial extension of closure member 60 on the order of approximately 0.020 inches, thereby producing a marginal edge portion 64 of the closure member of similar width that can be trapped between well wall 28 and the cup rim 12. In one preferred embodiment, for use with a conventional "small" coffee disposable cup, lid 10 may have a diameter of approximately 4½ inches, a width between cavity gripping walls 30, 32 on the order of 3/16 inch, the width of the drinking opening at the hinge on the order of 7/16 inch and the width of the arcuate outer edge of the drinking opening on the order of 1⅜ inches.

While the present invention has been described in connection with certain illustrated embodiments, it will be appreciated that modifications may be made without departing from the true spirit and scope of the invention. For example, the indentation that is flattened to produce the radial extension of the closure member may be formed in the body of the closure member between the hinge and the periphery of the lid. This and other modifications are deemed to be within the true scope of the invention.

That which is claimed is:

1. A lid for an open-mouthed drinking cup of the type having a rim portion about the mouth thereof, said lid comprising:

a cover portion for covering the open mouth of a drinking cup, said cover portion having a periphery;

an annular cavity at the periphery of the cover portion in the form of an inverted U-shaped well having an upper closed end and a pair of depending spaced-apart inner and outer walls joined to the closed end, said spaced-apart walls serving to frictionally engage the rim portion of a drinking cup;

the inner wall of said U-shaped well being interrupted along a discrete arcuate portion of the cover portion periphery while leaving the outer wall and at least a portion of the upper closed end of the U-shaped well uninterrupted;

said cover portion including a drinking section extending radially outwardly from a central location of said cover portion to the periphery of the cover portion and joining the upper closed end of said well along the discrete arcuate portion of the lid periphery where the inner wall is interrupted;

a drinking opening formed in said drinking section;

a closure member for the drinking opening, said closure member being hinged to the cover portion at a medial location thereon and having, in operation, a sufficient radial dimension to permit the outward marginal edge portion of the closure member to reside under the lid material at the upper closed end of said U-shaped well; and said cover portion and closure member including mating locking components for locking the closure member in a fully open position.

2. A drinking cup lid as claimed in claim 1 wherein said closure member is cut from the material of said drinking section while leaving an integral, living hinge connecting the closure member to the remainder of said cover portion.

3. A drinking cup lid as claimed in claim 2 including an indentation at the living hinge.

4. A drinking cup lid as claimed in claim 1 wherein the sides of said closure member include projecting ears and said drinking opening includes corresponding recesses.

5. A drinking cup lid as claimed in claim 1 wherein said closure member includes means engagable by hand to pivotally open the closure member about said hinge.

6. A drinking cup lid as claimed in claim 1 wherein said mating locking components comprise a hand-engagable projection on the closure member and a mating recess on the cover portion for receiving the projection by press fit.

7. A drinking cup lid as claimed in claim 1 wherein said discrete arcuate portion of the lid periphery is of about 25° to 60°.

8. A drinking cup lid as claimed in claim 1 formed of a styrene polymer.

9. A drinking cup lid as claimed in claim 8 having an average thickness of about 0.015 inches.

10. A drinking cup lid as claimed in claim 1 wherein the outward marginal edge portion of the closure member extends out sufficiently so that it may become trapped between the rim portion of the drinking cup and the upper closed end of said well when the lid is in place on a drinking cup.

11. A lid for an open-mouthed drinking cup having a rim portion about the mouth thereof, said lid comprising:

a cover portion for covering the open mouth of a drinking cup, said cover portion having a periphery;

an annular cavity at the periphery of the cover portion for frictionally engaging the rim portion of a drinking cup with sufficient gripping force to hold the lid thereon;

said cover portion including a raised drinking section extending outwardly and upwardly from a central location on said cover portion to the cover portion periphery and terminating at the upper level of said annular cavity such that there is no vertical lip where the raised drinking section reaches the periphery;

a drinking opening and mating closure member formed in said drinking section by cutting through said drinking section with first and second substantially radial cuts and a third cut joining the outer ends of the two radial cuts at the periphery of the cover portion while leaving an integral, living hinge connecting the closure member to the cover portion at a central location on the cover portion;

said closure member having a radial dimension sufficient for an outward marginal edge portion thereof, in operation, to extend outwardly beyond the third cut of said drinking opening; and said cover portion and closure member including mating locking components for locking the closure member in a fully open position.

12. A lid for an open-mouthed drinking cup having a rim portion about the mouth thereof, said lid comprising:

a cover portion for covering the open mouth of a drinking cup, said cover portion having a periphery;

an annular cavity at the periphery of the cover portion for frictionally engaging the rim portion of a drinking cup with sufficient gripping force to hold the lid thereon;

said cover portion including a drinking section extending outwardly from a central location on said cover portion to the cover portion periphery;

a drinking opening and mating closure member formed in said drinking section by cutting through said drinking section with first and second substantially radial cuts and a third cut joining the outer ends of the two radial cuts proximate the periphery of the cover portion while leaving an integral, living hinge connecting the closure member to the cover portion at a central location on the cover portion;

in operation, the outer marginal edge of said closure member extending outwardly beyond the third cut of said drinking opening; and said cover portion and closure member including mating locking components for locking the closure member in a fully open position.

13. A drinking cup lid as claimed in claim 12 wherein said third cut transcribes on angle of about 25° to 60°.

14. A drinking cup lid as claimed in claim 12 wherein the first, second and third cuts form three sides of the closure member and the fourth side of the closure member is formed by an integral, living hinge joining the closure member to the cover portion.

15. A combination drinking cup and lid comprising:

(a) a drinking cup having an open mouth and a rim portion about the mouth; and (b) a lid covering the open mouth of said drinking cup and providing access to the liquid contents thereof without removing the lid, said lid comprising:

a cover portion for covering the open mouth of a drinking cup, said cover portion having a periphery;

an annular cavity at the periphery of the cover portion frictionally engaging the rim portion of said drinking cup with sufficient gripping force to hold the lid thereon;

said cover portion including a drinking section extending outwardly from a central location on said cover portion to the cover portion periphery;

a drinking opening and mating closure member formed in said drinking section by cutting through said drinking section with first and second substantially radial cuts and a third cut joining the outer ends of the two radial cuts proximate the periphery of the cover portion while leaving an integral, living hinge connecting the closure member to the cover portion at a central location on the cover portion;

in operation, the outer marginal edge of said closure member extending outwardly beyond the third cut of said drinking opening; and said cover portion and closure member including mating locking components for locking the closure member in a fully open position.

16. A lid for an open-mouthed drinking cup having a rim portion about the mouth thereof, said lid comprising:

a cover portion for covering the open mouth of a drinking cup, said cover portion having a periphery;

an annular cavity at the periphery of the cover portion in the form of an inverted U-shaped well having an upper closed end and a pair of depending spaced-apart inner and outer walls joined to the closed end, said spaced-apart walls serving to frictionally engage the rim portion of a drinking cup;

the inner wall of said U-shaped well being interrupted along a discrete arcuate portion of the cover portion periphery while leaving the outer wall and at least a portion of the upper closed end of the U-shaped well uninterrupted;

said cover portion including a drinking section extending radially outwardly from a central location of said cover portion to the periphery of the cover portion and joining the upper closed end of said well along the discrete arcuate portion of the cover portion periphery where the inner wall is interrupted;

a drinking opening formed in said drinking section;

a closure member for the drinking opening, said closure member being hinged to the cover portion at a medial location thereon and having, in operation, a sufficient radial dimension to permit the outward marginal edge portion of the closure member to become trapped between the rim portion of the drinking cup and the upper closed end of said well when the lid is in place on a drinking cup.

17. A lid for an open-mouthed drinking cup having a rim portion about the mouth thereof, said lid comprising:

a cover portion for covering the open mouth of a drinking cup, said cover portion having a periphery;

an annular cavity at the periphery of the cover portion for frictionally engaging the rim portion of a drinking cup with sufficient gripping force to hold the lid thereon;

said cover portion including a raised drinking section extending outwardly and upwardly from a central location on said cover portion to the cover portion periphery and terminating at the upper level of said annular cavity such that there is no vertical lip where the raised drinking section reaches the periphery;

a drinking opening and mating closure member formed in said drinking section by cutting through said drinking section with radial cuts and a third cut proximate the periphery of the cover portion while leaving an integral, living hinge connecting the closure member to the cover portion at a central location on the cover portion, said living hinge being formed by an elongate indentation that provides said closure member with a radial dimension sufficient for an outward marginal edge portion thereof, in operation, to extend outwardly beyond the third cut of said drinking opening; and a hand engagable projection extending upwardly from said closure member permitting a user to repeatably move the closure member between an open drinking position and a closed, no-spill position by pivoting the closure member upwardly about said hinge to the open position followed by pivoting the closure member downwardly until the outward marginal edge portion of the closure member engages the lid material adjacent said third cut and, by deformation of the engaging materials, temporarily locks thereunder in the closed position.

18. A lid for an open-mouthed drinking cup having a rim portion about the mouth thereof, said lid comprising:

a cover portion for covering the open mouth of a drinking cup, said cover portion having a periphery;

an annular cavity at the periphery of the cover portion for frictionally engaging the rim portion of a drinking cup with sufficient gripping force to hold the lid thereon;

said cover portion including a drinking section extending outwardly from a central location on said cover portion to the cover portion periphery;

a drinking opening and mating closure member formed in said drinking section by cutting through said drinking section with radial cuts and a third cut proximate the periphery of the cover portions while leaving an integral, living hinge connecting the closure member to the cover portion at a central location on the cover portion, said living hinge being formed by an elongate indentation that, in operation, causes the outer marginal edge of said closure member to extend outwardly beyond the third cut of said drinking opening; and a hand engagable projection extending upwardly from said closure member permitting a user to repeatably move the closure member between an open drinking position and a closed, no-spill position by pivoting the closure member upwardly about said hinge to the open position followed by pivoting the closure member downwardly until the outward marginal edge portion of the closure member engages the lid material adjacent said third cut and, by deformation of the engaging materials, temporarily locks thereunder in the closed position.

19. A drinking cup lid as claimed in claim 18 including a recess formed in the cover portion that mates with said hand engagable projection on the closure member so that the closure member may be locked in a fully open position by press fitting the projection into the recess.

20. A lid for an open-mouthed drinking cup having a rim portion about the mouth thereof, said lid comprising:

a cover portion for covering the open mouth of a drinking cup, said cover portion having an annular cavity for frictionally engaging the rim portion of a drinking cup with sufficient gripping force to hold the lid thereon;

said cover portion including a drinking section extending outwardly from a central location on said cover portion;

a drinking opening and mating closure member formed in said drinking section by cutting through said drinking section with a pair of radial cuts that have first ends centrally located on the cover portion and second ends located outwardly on the cover portion, and a third cut joining the second ends of the radial cuts while leaving an integral, living hinge connecting the closure member to the cover portion along a line joining the first ends of the radial cuts, said living hinge being formed by an elongate indentation that, in operation, causes the outer marginal edge of said closure member to extend outwardly beyond the third cut of said drinking opening; and a hand engagable projection extending upwardly from said closure member permitting a user to repeatably move the closure member between an open drinking position and a closed, no-spill position by pivoting the closure member upwardly about said hinge to the open position followed by pivoting the closure member downwardly until the outward marginal edge portion of the closure member engages the lid material adjacent said third cut and, by deformation of the engaging materials, temporarily locks thereunder in the closed position.

21. A drinking cup lid as claimed in claim 20 including a recess formed in the cover portion that mates with said hand engagable projection on the closure member so that the closure member may be locked in a fully open position by press fitting the projection into the recess.

22. A lid for an open-mouthed drinking cup having a rim portion about the mouth thereof, said lid comprising:

a cover portion for covering the open mouth of a drinking cup, said cover portion having an annular cavity for frictionally engaging the rim portion of a drinking cup with sufficient gripping force to hold the lid thereon;

said cover portion including a drinking section extending outwardly from a central location on said cover portion;

a drinking opening and mating closure member formed in said drinking section by cutting through said drinking section with a pair of radial cuts that have first ends centrally located on the cover portion and second ends located outwardly on the cover portion, and a third cut joining the second ends of the radial cuts while leaving an integral, living hinge connecting the closure member to the cover portion along a line joining the first ends of the radial cuts, said closure member having a radial dimension sufficient for an outward marginal edge portion thereof, in operation, to extend outwardly beyond the third cut of said drinking opening; and a hand engagable projection extending upwardly from said closure member permitting a user to repeatedly move the closure member between an open drinking position and a closed, no-spill position by pivoting the closure member upwardly about said hinge to the open position followed by pivoting the closure member downwardly until the outward marginal edge portion of the closure member engages, the lid material adjacent said third cut and, by deformation of the engaging materials, temporarily locks thereunder in the closed position.

23. A drinking cup lid as claimed in claim 22 including a recess formed in the cover portion that mates with said hand engagable projection on the closure member so that the closure member may be locked in a fully open position by press fitting the projection into the recess.

* * * * *